US012319536B2

(12) United States Patent
Takita

(10) Patent No.: US 12,319,536 B2
(45) Date of Patent: Jun. 3, 2025

(54) DOCUMENT TRANSPORT DEVICE, DOCUMENT TRANSPORT METHOD, AND DOCUMENT TRANSPORT CONTROL SYSTEM

(71) Applicant: SEIKO EPSON CORPORATION, Tokyo (JP)

(72) Inventor: Kazuya Takita, Shimonoseki (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 18/062,474

(22) Filed: Dec. 6, 2022

(65) Prior Publication Data

US 2023/0183031 A1 Jun. 15, 2023

(30) Foreign Application Priority Data

Dec. 9, 2021 (JP) ..... 2021-199910

(51) Int. Cl.
*B65H 7/12* (2006.01)
*B65H 5/06* (2006.01)

(52) U.S. Cl.
CPC ..... *B65H 7/12* (2013.01); *B65H 5/062* (2013.01); *B65H 2701/1914* (2013.01)

(58) Field of Classification Search
CPC ..... B65H 7/125; B65H 7/12; B65H 2553/30; B65H 2511/524; B65H 2511/13; B65H 5/062; B65H 2701/1914; B65H 2511/521
See application file for complete search history.

(56) References Cited

U.S. PATENT DOCUMENTS 7,822,376 B2 * 10/2010 Nagano ..... G03G 15/6511 399/388
9,027,919 B2 * 5/2015 Fukusaka ..... B65H 3/128 271/262
2003/0006550 A1 * 1/2003 Chujo ..... B65H 7/125 271/262
2011/0282487 A1 11/2011 Niwano
2013/0069299 A1 3/2013 Matsuoka
2019/0342461 A1 * 11/2019 Honda ..... H04N 1/00729
2020/0204695 A1 6/2020 Sakai
(Continued)

FOREIGN PATENT DOCUMENTS

JP 2008-271537 A 11/2008
JP 2011-244092 A 12/2011
(Continued)

*Primary Examiner* — Luis A Gonzalez
(74) *Attorney, Agent, or Firm* — WORKMAN NYDEGGER

(57) ABSTRACT

A theoretical threshold corresponding to a transport path is set, and a control unit acquires a calculation value calculated based on a detection result of double feeding detection unit and a transport length of a document, determines occurrence of double feeding when the calculation value is greater than the theoretical threshold (step S120), and determines non-occurrence of double feeding when the calculation value is smaller than the theoretical threshold. In addition, if a non-detection period for double feeding occurs (step S110), the control unit sets a cumulative value in step S115. As a result, detection of double feeding is ended in a short period while a document is being transported, and in a case that double feeding is no longer detected, determination of double feeding will not be made.

18 Claims, 23 Drawing Sheets

(56) References Cited

U.S. PATENT DOCUMENTS

| | | | | |
|---|---|---|---|---|
| 2021/0037153 | A1* | 2/2021 | Beppu | H04N 1/00628 |
| 2021/0155430 | A1* | 5/2021 | Furukawa | H04N 1/00591 |
| 2022/0258996 | A1* | 8/2022 | Sakai | B65H 5/062 |

FOREIGN PATENT DOCUMENTS

| | | | | |
|---|---|---|---|---|
| JP | 2013-063843 | A | | 4/2013 |
| JP | 2017-013981 | A | | 1/2017 |
| JP | 2020-100459 | A | | 7/2020 |
| JP | 2020132373 | A | * | 8/2020 |
| JP | 2021-167237 | | | 10/2021 |

* cited by examiner

DOCUMENT TRANSPORT DEVICE, DOCUMENT TRANSPORT METHOD, AND DOCUMENT TRANSPORT CONTROL SYSTEM

The present application is based on, and claims priority from JP Application Serial Number 2021-199910, filed Dec. 9, 2021, the disclosure of which is hereby incorporated by reference herein in its entirety.

BACKGROUND

1. Technical Field

The present disclosure relates to a document transport device, a document transport method, and a document transport control system for transporting a document placed on a placement unit along a predetermined transport path.

2. Related Art

Scanners of the related art that are capable of automatic paper feeding have a function of detecting double feeding of documents and, upon detecting double feeding, they stop document feeding and reading. In order to detect double feeding, such scanners have an ultrasonic wave transmitter and an ultrasonic wave receiver facing each other having a document therebetween to determine double feeding based on a degree of attenuation of the intensity of ultrasonic waves when documents are fed.

Instant photographs are configured to have partially different thicknesses, which may easily cause false detection of double feeding even when no double feeding occurs. A sheet with a photograph or a sticker attached has different thicknesses in different parts, and thus, a false detection of double feeding is likely to occur even when no double feeding occurs.

When double feeding is detected, a user manually removes the documents, reloads a document on the platen, and performs an operation to start reading again.

In the disclosure disclosed in JP-A-2008-271537, it is possible to determine processing to be performed after double feeding is detected in advance. Documents that are prone to false detection of double feeding can be set in advance such that troublesome resetting and re-reading processing are not necessary.

According to the disclosure disclosed in JP-A-2008-271537 described above, actual double feeding is not processed as double feeding, and as a result, a probability of incorrect reading increases.

The present disclosure aims to enable reading to be performed as correct as possible while the trouble caused by false detection of double feeding is reduced.

SUMMARY

The present disclosure includes a placement unit on which a document is placed, a transport unit configured to transport the document placed on the placement unit along a predetermined transport path, a processing unit configured to perform processing on the transported document, a double feeding detection unit configured to detect double feeding of the document along the transport path, and a control unit configured to determine occurrence of double feeding, in which the control unit acquires a theoretical threshold corresponding to the transport path and a calculation value calculated based on a detection result of the double feeding detection unit and a transport length of the document, determines the occurrence of double feeding when the calculation value is greater than the theoretical threshold, and determines non-occurrence of double feeding when the calculation value is smaller than the theoretical threshold.

In the present disclosure configured as described above, when the transport unit transports a document placed on the placement unit along a predetermined transport path, the processing unit performs predetermined processing on the document transported along the transport path. The double feeding detection unit can detect double feeding of a document along the transport path, and the control unit determines the occurrence of double feeding based on the detection result from the double feeding detection unit.

In addition, a theoretical threshold corresponding to a transport path is set, and the control unit acquires a calculation value calculated based on a detection result of the double feeding detection unit and a transport length of a document, determines occurrence of double feeding when the calculation value is greater than the theoretical threshold, and determines non-occurrence of double feeding when the calculation value is smaller than the theoretical threshold. Further, even when the calculation value is smaller than the theoretical threshold, it does not disturb determination of double feeding caused by other factors.

In other words, in addition to the detection result of the double feeding detection unit, the calculation value calculated based on the transport length of the document is acquired. In this way, the transport length of the document while double feeding is detected can be inferred, and it is determined occurrence of double feeding when a calculation value corresponding to the transport length is greater than the theoretical threshold, and it is determined non-occurrence of double feeding when the calculation value is smaller than the theoretical threshold. In other words, when detection of double feeding ends in a short period while a sheet is being transported, and then double feeding is no longer detected, double feeding is not determined.

DESCRIPTION OF EXEMPLARY EMBODIMENTS

Exemplary embodiments of the present disclosure will be described below based on the accompanying drawings.

Figure 1:
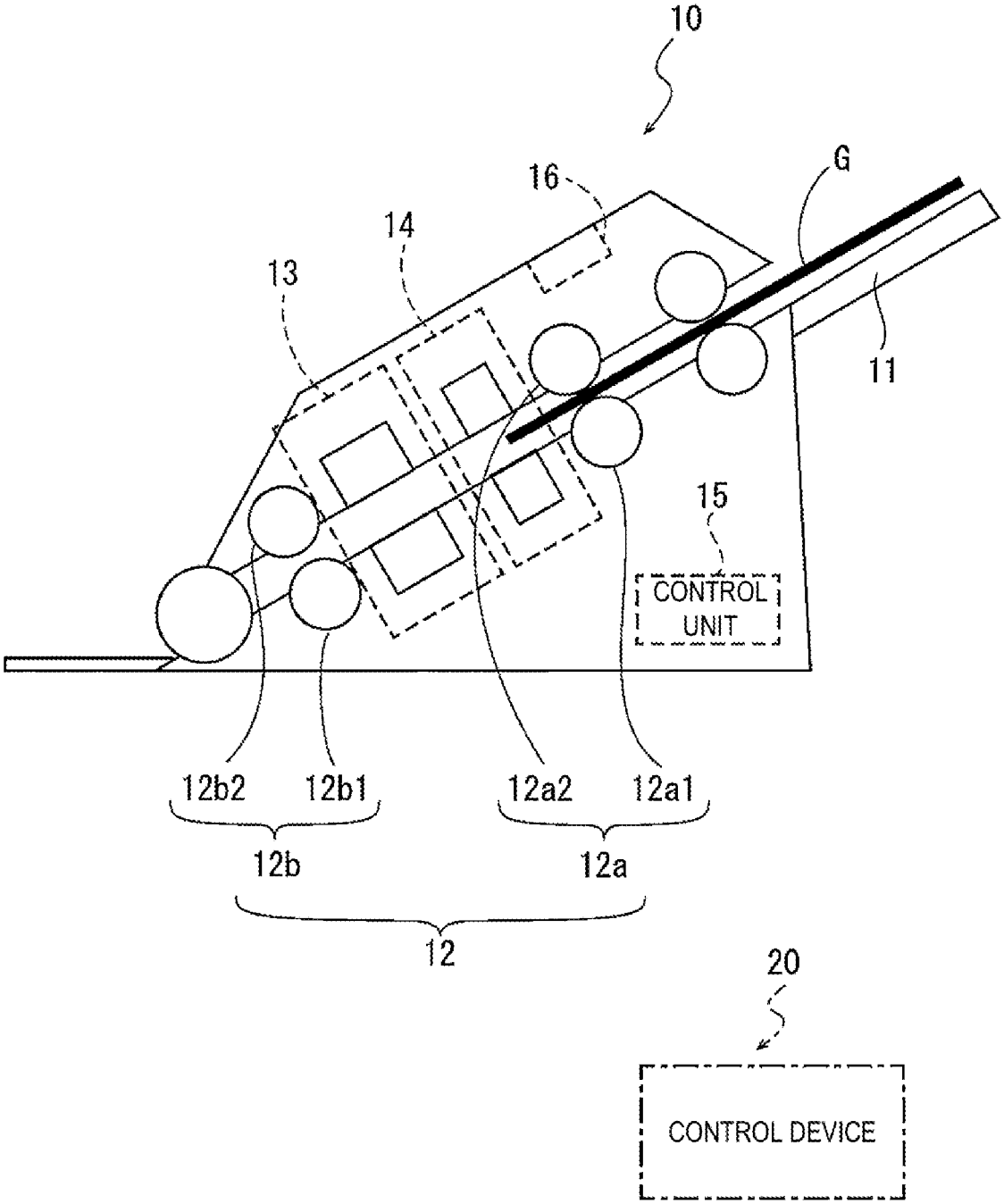
FIG. 1 is a schematic view of an image reading device to which a document transport device according to an embodiment of the present disclosure is applied.

FIG. 1 illustrates a schematic diagram of an image reading device to which a document transport device is applied according to an embodiment of the present disclosure.

The image reading device 10 includes a placement unit 11 on which a document G is placed, a transport unit 12 that conveys the document G placed on the placement unit 11 along a predetermined transport path, a reading unit 13 that reads the conveyed document G, a double feeding detection unit 14 that detects double feeding of documents G along the transport path, a control unit 15 that determines occurrence of double feeding based on a detection result from the double feeding detection unit 14, and a touch panel 16 that can perform display and input. Further, although the control unit 15 determines the occurrence of double feeding in the image reading device 10 in the present example, in a system in which a control device 20, such as an external personal computer, and an image reading device 10 are connected, the control device 20 may determine the occurrence of double feeding, instead of the control unit 15. In addition, although the reading unit 13 performs a reading process on the conveyed document G in the present example, a process performed on the conveyed document G is not limited to reading, and a processing unit that performs other processes may be set to perform further processes on the read image. In addition, if a course of a process performed by the control unit 15 in a time-series manner is regarded as respective steps, the time-series link of the steps can be construed as one method disclosure.

The transport unit 12 includes a first transport roller pair 12*a* (12*a*1 and 12*a*2) and a second transport roller pair 12*b* (12*b*1 and 12*b*2) that are aligned in a direction across the transport path to sandwich the transport path. The first transport roller 12*a*1 and the second transport roller 12*b*1 are disposed on the lower side of the transport path and coupled to a drive mechanism to be rotationally driven. The first transport roller pair 12*a* transports the document G to the reading unit 13, and the second transport roller pair 12*b* transports and discharges the document G read by the reading unit 13.

The length from the nip position of the first transport roller pair 12*a* to the nip position of the second transport roller pair 12*b* in the transport direction corresponds to the length of the minimum document that can be transported by the transport unit 12. The length is referred to as the length of the minimum document, which is a length of a specific document with respect to the image reading device 10. For an example, the length of the specific document may be set to the length of a short side of a business card. For another example, the length of the specific document may be set to a longitudinal length of an instant photographic sheet. The instant photographic sheet may have an uneven thickness.

In this way, the length of the specific document is set based on the length of the minimum sheet that is transportable by the transport unit 12.

Typically, the minimum sheet that can be scanned is the business card, which is transported in a state that the short side of the business card is along the transport direction. When the length of the specific document is set based on the business card, cases in which a double feeding is determined while a business card is being transported decreases, and thus troublesome operations can be prevented.

In addition, when the length of the specific document is set based on the instant photographic sheet which is likely to be mis-detected as errors, cases in which a double feeding is determined while an instant photographic sheet is being transported decrease, and thus troublesome operations can be prevented.

The reading unit 13 includes a pair of line sensors facing each other across the transport path, and the line sensors read images on both sides of the document G transported in the transport direction. The double feeding detection unit 14 includes an ultrasonic wave transmitter which transmits ultrasonic wave and an ultrasonic wave receiver which receives the ultrasonic wave. The ultrasonic wave transmitter and the ultrasonic wave receiver face each other through the transport path. The double feeding detection unit 14 detects double feeding based on an attenuation of ultrasonic wave when the document G passes between the ultrasonic wave transmitter and the ultrasonic wave receiver. Specifically, when an output signal of the ultrasonic wave receiver is compared to a threshold and the output signal of the ultrasonic wave receiver is greater than the predetermined threshold, it is detected that there is one document G, and when the output signal of the ultrasonic wave receiver is smaller than the predetermined threshold, it is detected that there are multiple documents G and that double feeding is occurring. However, the detection of the double feeding along the transport path is not a final determination, and the control unit 15 makes a determination of double feeding considering other factors as well.

The touch panel 16 displays a predetermined image based on an instruction from the control unit 15, and outputs a touch position at which the user has made a touch operation to the control unit 15. The control unit 15 can instruct display of the menu to the user, or acquire the user's operation content based on the touch operation position by the user.

Figure 2:
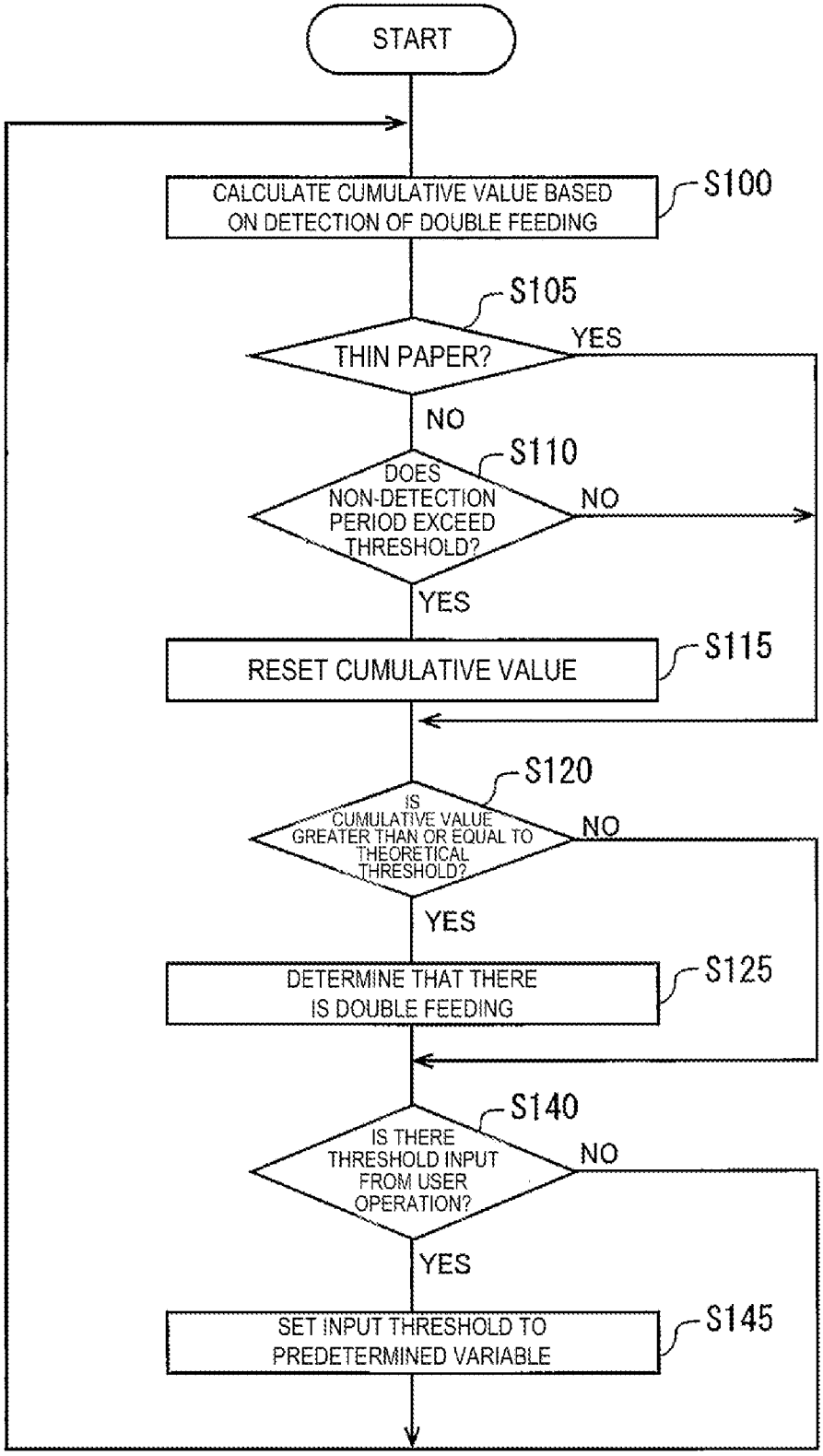
FIG. 2 is a flowchart of control performed by a scanner.

FIG. 2 shows a flowchart of control performed by the image reading device 10.

The control unit 15 calculates a cumulative value based on double feeding in step S100. Further, the cumulative value corresponds to an example of a calculation value of the present disclosure. The double feeding detection unit 14 detects occurrence of double feeding at fixed intervals, and the control unit 15 inputs the detection results.

Figure 3:
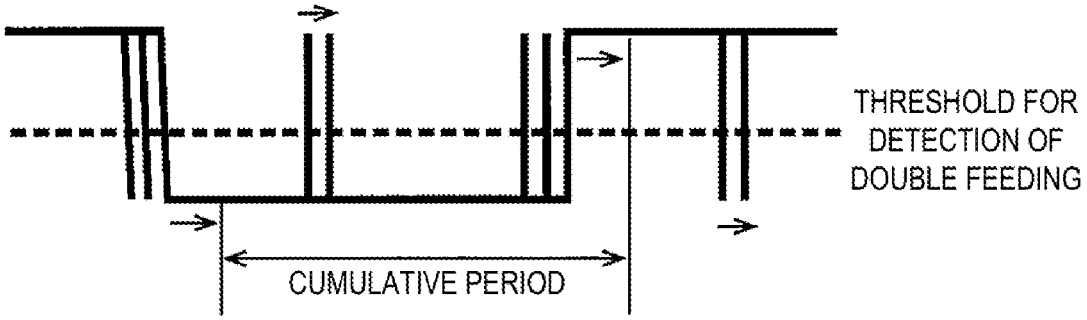
FIG. 3 is a diagram illustrating a relationship between detection of double feeding and cumulative values.

FIG. 3 is a diagram illustrating a relationship between detection of double feeding and cumulative values.

In the drawing, the dashed line indicates a predetermined threshold for detection of double feeding, and the solid lines indicate intensities of an output signal. The portions depicted in spike shapes in the longitudinal direction are noise-affected portions.

The double feeding detection result of the double feeding detection unit 14 is merely a comparison result of the intensity of the output signal of the ultrasonic wave receiver at every predetermined timing and the predetermined threshold, and noise caused by the environment should be included. For this reason, the control unit 15 performs noise suppression, such as taking integrated values, for example, while making a preliminary determination of double feeding based on the integrated values in units of a few cycles. When it is detected that "there is double feeding" in the preliminary determination of double feeding, in other words, when the value of the output signal exceeds the predetermined threshold, counter variables increase at every predetermined sampling timing. In this way, the value of counter variables indicates the length of the period in which preliminary determination of double feeding was made. Furthermore, the transport length, in other words, the length of double feeding, can be ascertained by multiplying the transport speed of the document G by the length of the period. In this way, a cumulative value is calculated as a value corresponding to a transport length of a document, and corresponds to the calculation value of the present disclosure.

A period in which double feeding is continuous can be defined with a sampling interval at which double feeding detection values are sampled and the number of sampling operations n. That is, a sampling interval times n equals a period in which double feeding is continuous.

$$(\text{a period in which double feeding is continuous})=(\text{a sampling interval})\times n.$$

When determination is made with such the cumulative value, it is possible to prevent a document with a plurality of regions that are likely to be erroneously determined as double feeding such as an instant photographic sheet from being erroneously determined as double feeding. In addition, because the cumulative value is reset when the cumulative value does not meet a predetermined theoretical threshold, double feeding is not determined in a certain double feeding range, which is a detection length, even for an instant photographic sheet or a document with many sticky notes, and thus erroneous determination of double feeding can be prevented. Further, the preliminary determination includes not only a determination made by the control unit 15, or the like but also a process that ignores noise components based on an integrated value.

Next, in step S105, the control unit 15 determines whether the sheet is thin. Whether the sheet is thin may be specified by the user initially on the touch panel 16, or may be determined based on an output signal of the ultrasonic wave receiver of the double feeding detection unit 14.

When the sheet is not thin, the control unit determines whether a non-detection period exceeds a threshold in step S110.

As illustrated in FIG. 3, when it is determined that "there is double feeding" in the preliminary determination for double feeding (also referred to as "during a cumulative period"), predetermined counter variables increase. Although the preliminary determination is a process that is designed not to be affected by the presence or absence of noise, in a case in which there is no double feeding in the preliminary determination, the cumulative value is not changed since the cumulative value does not increase.

When it is determined that "there is not double feeding" in the preliminary determination for double feeding, increasing is performed to determine a non-detection period. When the increasing value exceeds a certain value, a non-detection period is determined. In other words, the control unit 15 resets the cumulative value in step S115. The effect of this processing will be described below based on specific examples.

Figure 4:
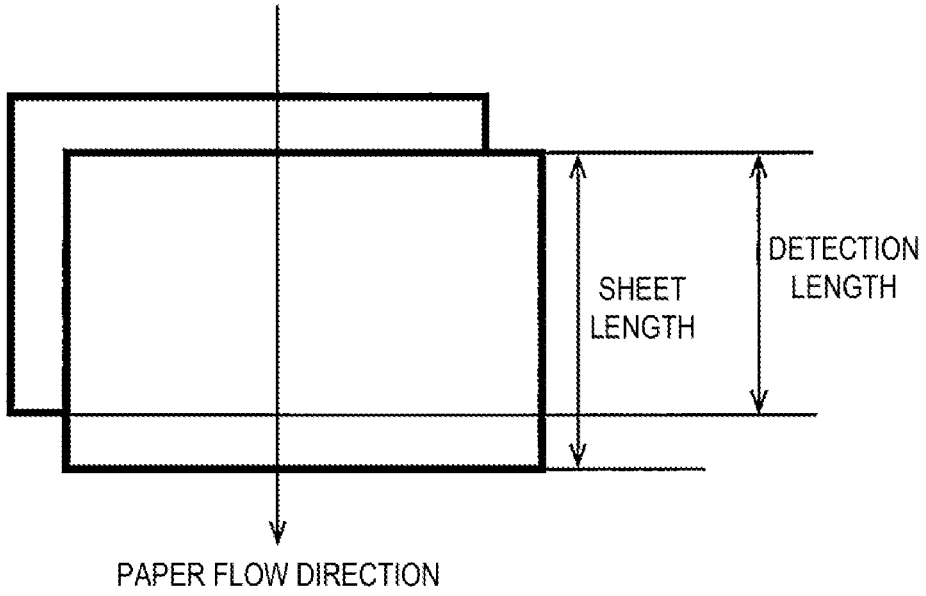
FIG. 4 is a diagram illustrating a theoretical threshold corresponding to a transport path.

FIG. 4 is a diagram illustrating a theoretical threshold corresponding to a transport path.

The sheet illustrated in the drawing is assumed as a business card with a sheet length that is the length of the minimum document. In the present example, while a double feeding length is shorter than the length of the sheet, double feeding is not "determined" while double feeding is "detected". In addition, a detection length to be compared is shorter than the sheet length. Specifically, (detection length) =(sheet length)−(overlapping margin+end surface variation) is satisfied. Here, the "end surface variation" is a parameter intended for a variation at the position where a sheet end is detected when a document is transported. The "overlap margin" is a parameter considering the length of a region of a minimum sheet where double feeding is detected.

For example, when double feeding of the two minimum sheets is detected, regions where double feeding is detected in a case in which the preceding sheet entirely overlaps the subsequent sheet are different from regions where double feeding is detected in a case in which the preceding sheet partially overlaps the subsequent sheet. In a case in which the preceding sheet entirely overlaps the subsequent sheet, it is possible to determine double feeding with a detection length obtained by subtracting the value calculated in consideration of an end surface variation from the length of the preceding sheet. On the other hand, in a case in which the preceding sheet partially overlaps the subsequent sheet, the length of the region where double feeding is detected will be shorter, and thus, it may not be possible to determine double feeding with the detection length described above.

Thus, the "double feeding margin" is subtracted from the "sheet length". This makes it possible to detect double feeding even when the preceding sheet partially overlaps the subsequent sheet.

In addition, the parameters of the increasing interval based on the output signal of the double feeding detection unit 14 and the document feed amount corresponding to the shortest period required for the integration process for noise countermeasures may be subtracted.

The end surface variation is affected by a paper thickness, a sampling timing, and the like, and when the paper is thin, detection is not stable. For this reason, by subtracting the end surface variation and setting the detection length, the determination of double feeding can be stabilized. This is because, although the overlap margin is also subtracted from the sheet length, in addition to the end surface variation when determining the detection length, it does not prevent a factor other than the end surface variation from being subtracted.

There are cases in which double feeding is not correctly detected in regions before and after a document in the transport direction depending on tolerance of the document, displacement of the document from the transport position, or the like. However, the effect of the tolerance of the document, the displacement of the document from the transport position, or the like can be suppressed by setting the value obtained by subtracting the length of the unstable portion of the end portion to a theoretical threshold as in the present example.

The control unit 15 determines whether the cumulative value is equal to or greater than the theoretical threshold in step S120, and when the value is equal to or greater than the theoretical threshold, the control unit 15 determines occurrence of double feeding in step S125, and performs processing such as notification of the double feeding error. On the other hand, when the cumulative value is less than the theoretical threshold, it is determined non-occurrence of double feeding, and no particular processing is performed.

FIG. 5 is a diagram illustrating a timing at which double feeding is determined.

Figure 5A:
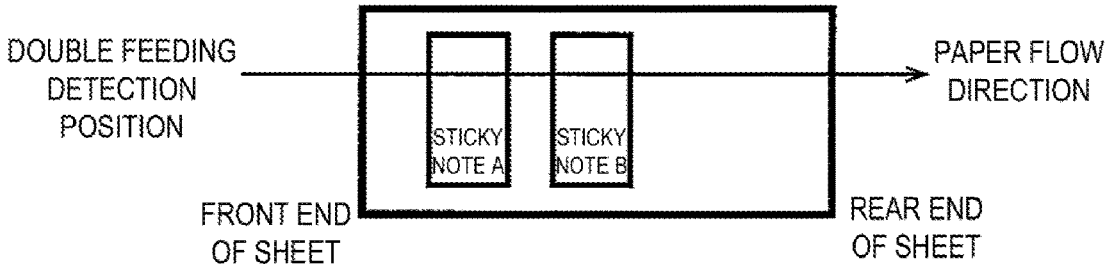
FIG. 5A is a diagram schematically illustrating a document.
Figure 5B:
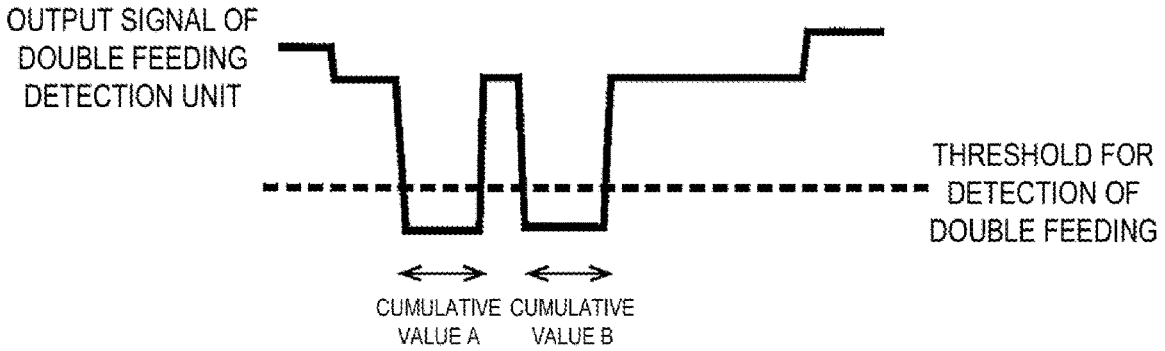
FIG. 5B is a diagram illustrating an output signal and a threshold of a ultrasonic wave receiver after amplification at a double feeding detection unit.

FIG. 5A schematically illustrates a document, and FIG. 5B illustrates an output signal of the ultrasonic wave receiver after amplification and a threshold for the double feeding detection unit 14.

Even when sticky notes A and B are attached to the document, the document length is shorter than the detection length, and thus a non-detection period occurs after the sticky notes A and B pass over the double feeding detection position, and cumulative values are reset. Thus, the cumulative values are less than the theoretical threshold, and it is determined non-occurrence of double feeding.

Figure 6:
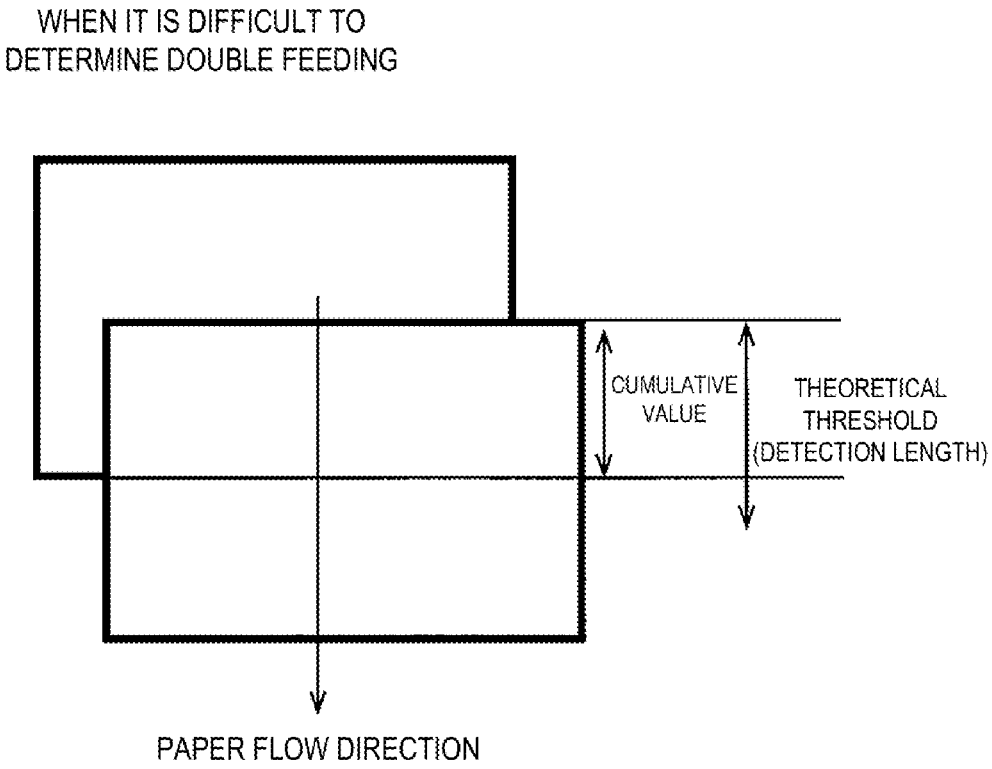
FIG. 6 is a schematic view of a case in which it is not possible to determine double feeding.
Figure 7:
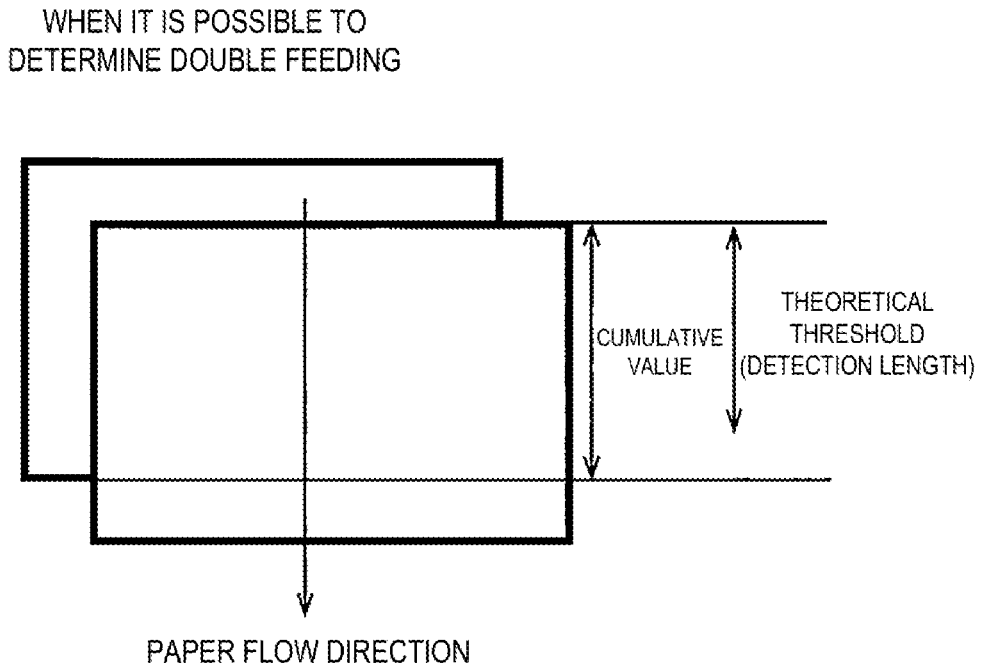
FIG. 7 is a schematic view of a case in which it is possible to determine double feeding.

FIG. 6 is a schematic diagram of a case in which double feeding cannot be determined, and FIG. 7 is a schematic diagram of a case in which double feeding can be determined.

Because the detection length, which is the theoretical threshold, is determined in this example, it is not possible to determine double feeding unless a cumulative value based on a double feeding detection result of the double feeding detection unit 14 exceeds the detection length. In the case of double feeding as illustrated in FIG. 6, the cumulative value is reset before the cumulative value exceeds the detection length, and thus double feeding cannot be determined. In the case of double feeding as illustrated in FIG. 7, the cumulative value is greater than the detection length, and thus double feeding can be determined.

Figure 8A:
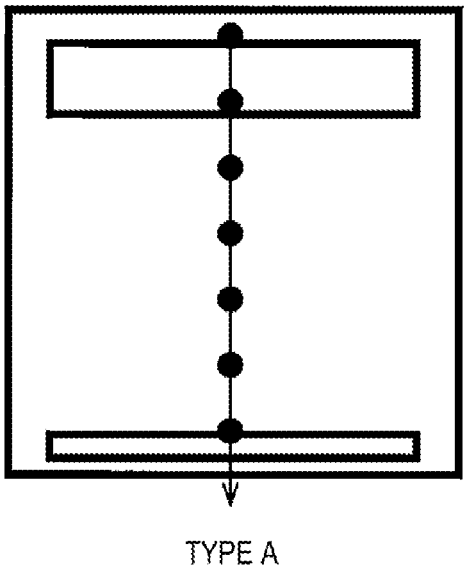
FIG. 8A is a diagram illustrating a back surface of an instant photograph.
Figure 8B:
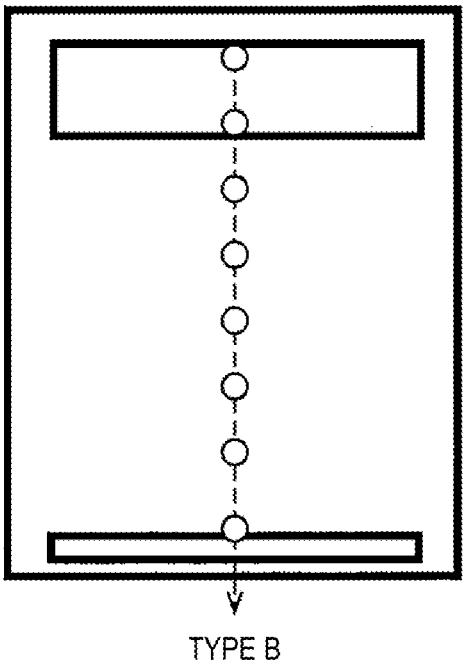
FIG. 8B is a diagram illustrating a back surface of an instant photograph.
Figure 8C:
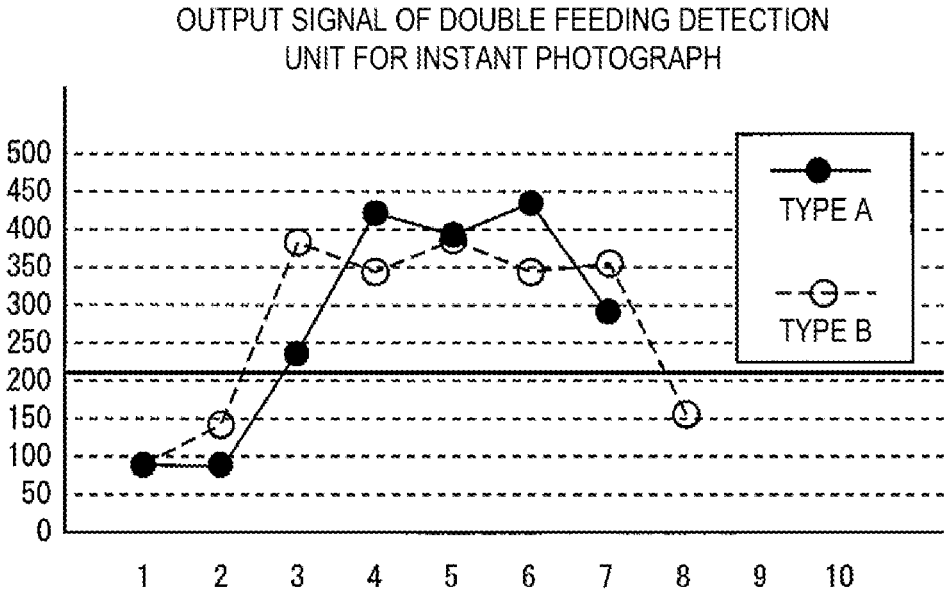
FIG. 8C is a diagram showing output signals of a double feeding detection unit 14.

FIGS. 8A and 8B are diagrams illustrating back surfaces of an instant photograph, and FIG. 8C is a diagram showing an output signal of the double feeding detection unit 14.

The back surfaces of the instant photograph include a portion having a larger thickness than other portions, such as a portion containing chemicals, and thus a portion with a low-intensity output signal of the double feeding detection unit 14 occurs even if the photograph is single paper. In addition, a pattern in which a portion with a low-intensity output signal of the double feeding detection unit 14 occurs differs depending on types of instant photograph.

Figure 9:
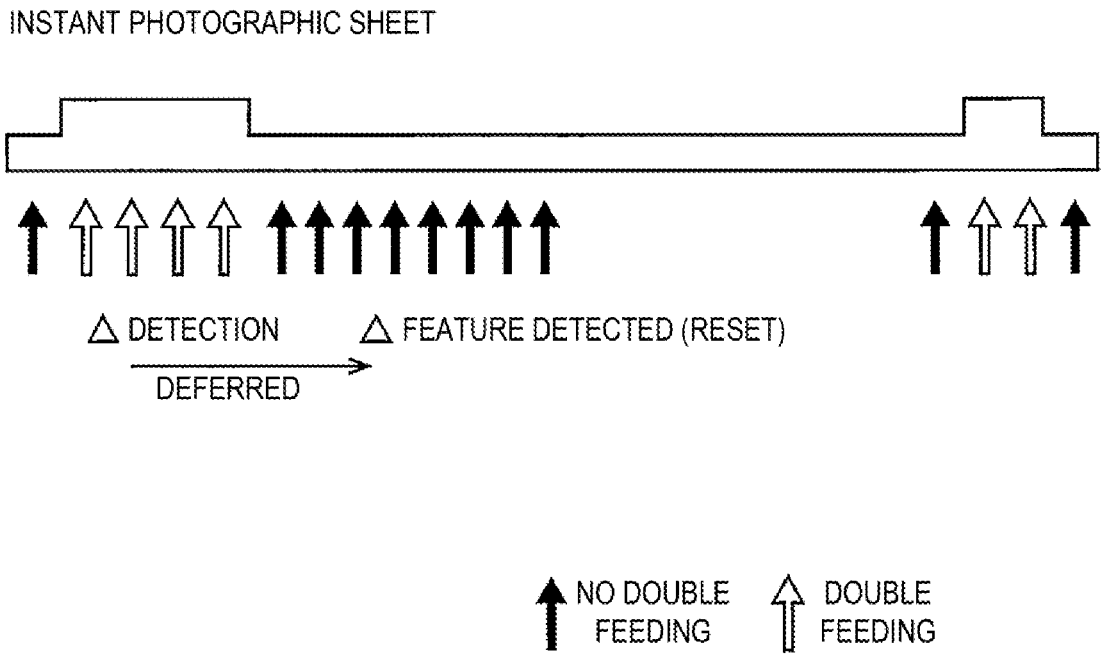
FIG. 9 is a diagram illustrating a side surface of an instant photographic sheet and a detection result of the double feeding detection unit.

FIG. 9 is a diagram illustrating a side surface of an instant photographic sheet and a detection result of the double feeding detection unit.

There is a thick portion on the back surface of the instant photographic sheet as illustrated in FIGS. 8A and 8B, and when this portion passes through the double feeding detection unit 14, the double feeding detection unit 14 outputs the detection result obtained by detecting double feeding as shown in FIG. 8C. In FIG. 9, the portion for which double feeding is detected is indicated by white arrows. However, while the section for which double feeding is detected has an increasing cumulative value, the thick portion passes through the double feeding detection unit 14 before the cumulative value exceeds the detection length. Thus, the cumulative value is reset at the time point at which the non-detection period for double passes feeding thereafter.

This processing can also be expressed such that, while the detection of double feeding by the double feeding detection unit 14 is performed, determination of double feeding from the time point at which double feeding is no longer detected is deferred, detection of a fixed non-detection period is determined as "feature detected", and the cumulative value is reset at the time when features are detected.

Figure 10:
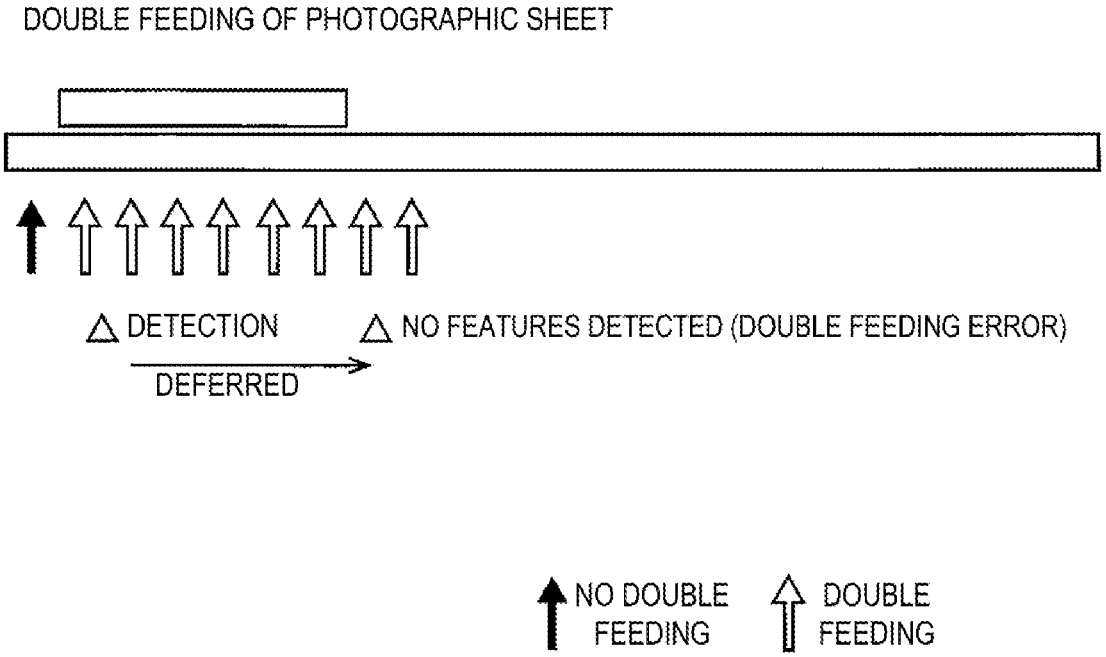
FIG. 10 is a diagram illustrating a side surface of photographic sheet attached to paper, the photographic sheet having a length exceeding a detection length and a detection result of the double feeding detection unit.

FIG. 10 is a diagram illustrating a side surface of a sheet with a photographic sheet having a length longer than the detection length attached, and a detection result of the double feeding detection unit.

Compared to FIG. 9, the cumulative value of the double feeding-detected section increases and then exceeds the detection length in some cases. Then, even if the non-detection period for double feeding is exceeded thereafter, the process of notification of double feeding error is performed before that.

This process can be expressed such that, it is not determined to be "features detected" after the double feeding detection unit 14 detects double feeding, and thus the cumulative value is not reset, and the process of notification of double feeding is performed.

Individual documents of various types will be described below on the premise of the process based on the above-described flowchart.

Figure 11:
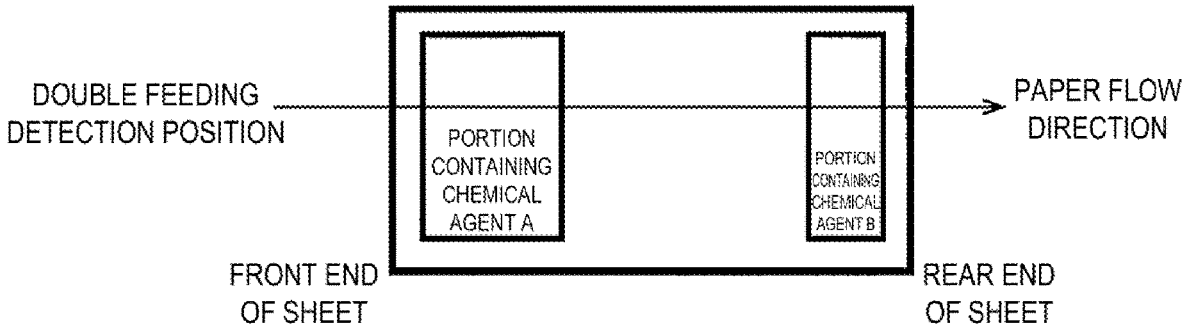
FIG. 11 is a top view of an instant photographic sheet.
Figure 12:
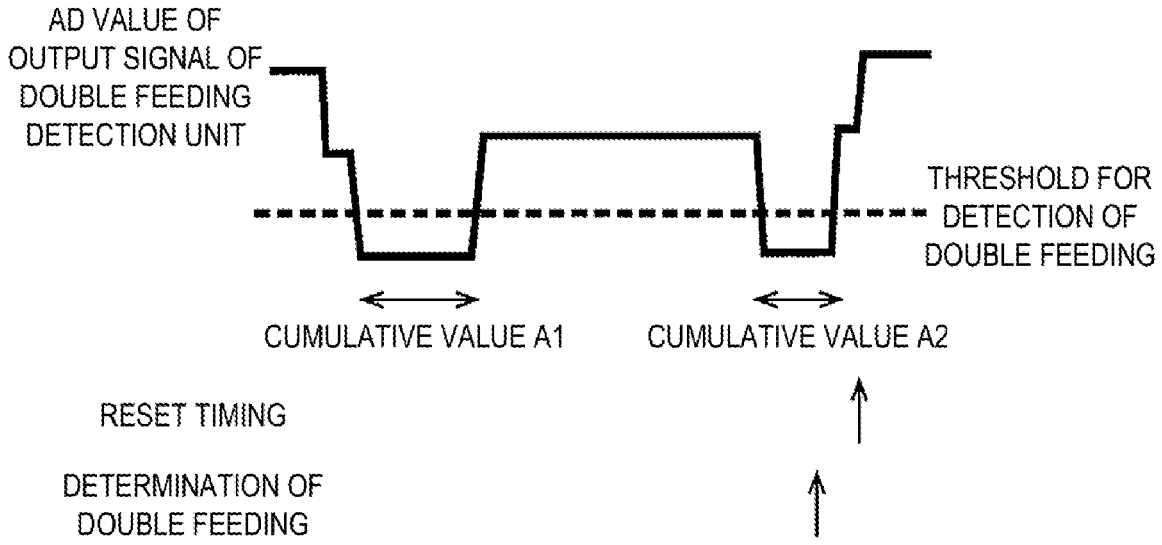
FIG. 12 is a diagram illustrating an output signal of the double feeding detection unit.

FIGS. 11 and 12 are diagrams illustrating the course of processing an instant photographic sheet using double feeding determination of the related art, and FIG. 11 is a top view of the instant photographic sheet, and FIG. 12 is a diagram illustrating an output signal of the double feeding detection unit.

As illustrated in FIG. 11, there are portions containing a chemical agent A and a chemical agent B on the back surface of the instant photographic sheet, and the portions are thicker than other portions. Thus, when the portions containing the chemical agent A and the chemical agent B pass the double feeding detection unit 14, the output signal of the double feeding detection unit 14 becomes low and less than the threshold of double feeding detection as illustrated in FIG. 12.

Although the cumulative value increases in the double feeding detection period when the double feeding determination of the related art is applied, in this example, the cumulative value does not exceed the threshold for the double feeding determination when the portion containing the chemical agent A passes the double feeding detection unit 14, but the cumulative value exceeds the threshold for the double feeding determination when the portion containing the chemical agent B passes the double feeding detection unit 14. Then, the double feeding error is notified. In other words, the cumulative value increases to a cumulative value A1 at the portion containing the chemical agent A, and continuously increases further to a cumulative value A2 at the portion containing the chemical agent B.

Figure 13:
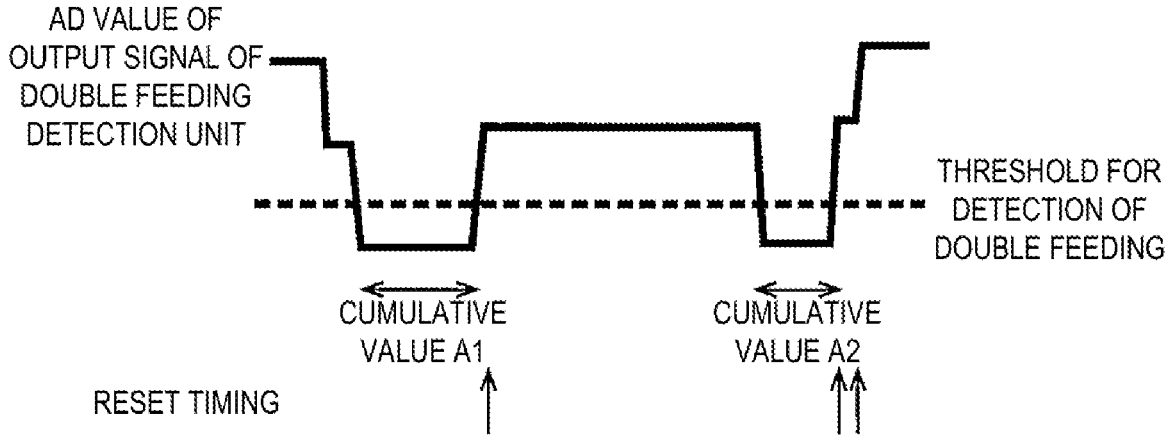
FIG. 13 is a diagram illustrating an output signal of the double feeding detection unit.

FIG. 13 is a diagram illustrating the course of processing an instant photographic sheet illustrated in FIG. 11 by using double feeding determination of the present disclosure, and is a diagram illustrating an output signal of the double feeding detection unit.

In double feeding determination of the present example, the cumulative value increases during the double feeding detection period, and the cumulative value increases to the cumulative value A at the portion containing the chemical agent A. However, the cumulative value is reset in step S115 when the non-detection period is determined to have exceeded the threshold in step S110 after the portion containing the chemical agent A passed the double feeding detection unit 14.

Thus, when the portion containing the chemical agent B starts to pass the double feeding detection unit 14, the cumulative value newly starts increasing from the reset state. Then, when the portion containing the chemical agent B passes the double feeding detection unit 14, the cumulative value increases to a cumulative value B. Because both the cumulative value A and the cumulative value B are less than the detection length, it is not determined that the cumulative value exceeds the theoretical threshold in step S120. Furthermore, when the non-detection period is then determined to have exceeded the threshold in step S110, the cumulative value is reset. Further, the cumulative value is reset for the rear end of the sheet.

Figure 14:
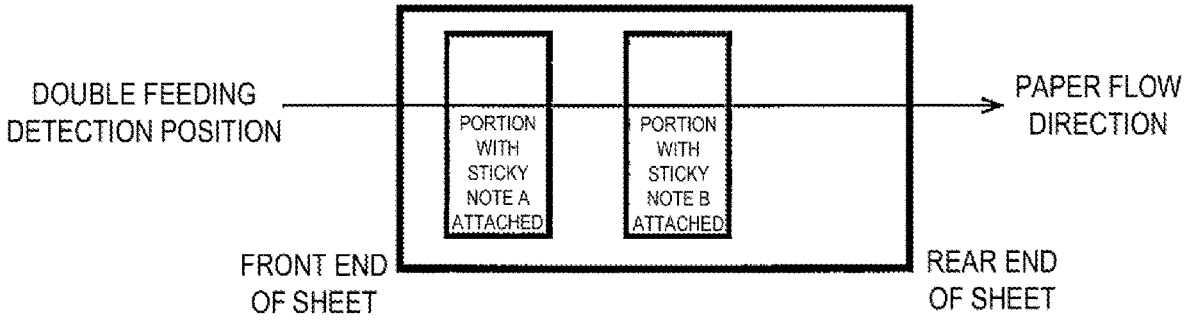
FIG. 14 is a top view of a sheet.
Figure 15:
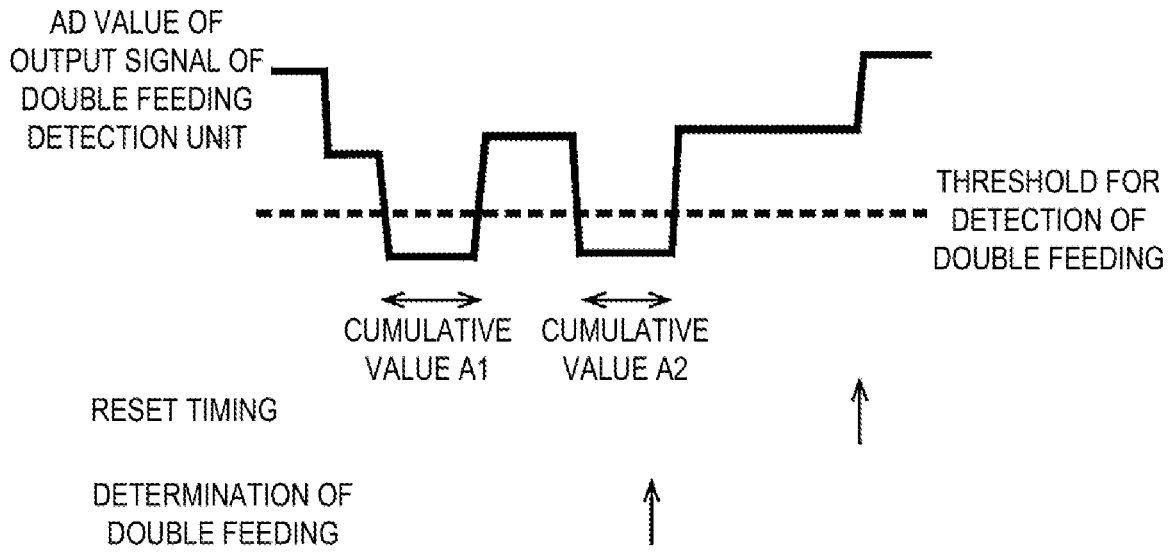
FIG. 15 is a diagram illustrating an output signal of the double feeding detection unit.

FIGS. 14 and 15 are diagrams illustrating the course of processing a sheet to which sticky notes are attached at two locations by using the double feeding determination of the related art, and FIG. 14 is a top view of the sheet, and FIG. 15 is a diagram illustrating an output signal of the double feeding detection unit.

The sheet with sticky notes attached at two locations is processed as illustrated in FIG. 14. The portions with the sticky notes attached are thicker than other portions. For this reason, when the sticky note A and the sticky note B pass the double feeding detection unit 14, the output signal of the double feeding detection unit 14 becomes low and less than the threshold of double feeding detection as illustrated in FIG. 15.

Although the cumulative value increases in the double feeding detection period when the double feeding determination of the related art is applied, in this example, the cumulative value does not exceed the threshold for the double feeding determination yet when the portion with the sticky note A attached passes the double feeding detection unit 14, but the cumulative value exceeds the threshold for the double feeding determination when the portion with the sticky note B attached passes the double feeding detection unit 14. Then, the double feeding error is notified. In other words, the cumulative value increases to the cumulative value A1 at the portion with the sticky note A attached, and continuously increases further to the cumulative value A2 at the portion with the sticky note B attached.

Figure 16:
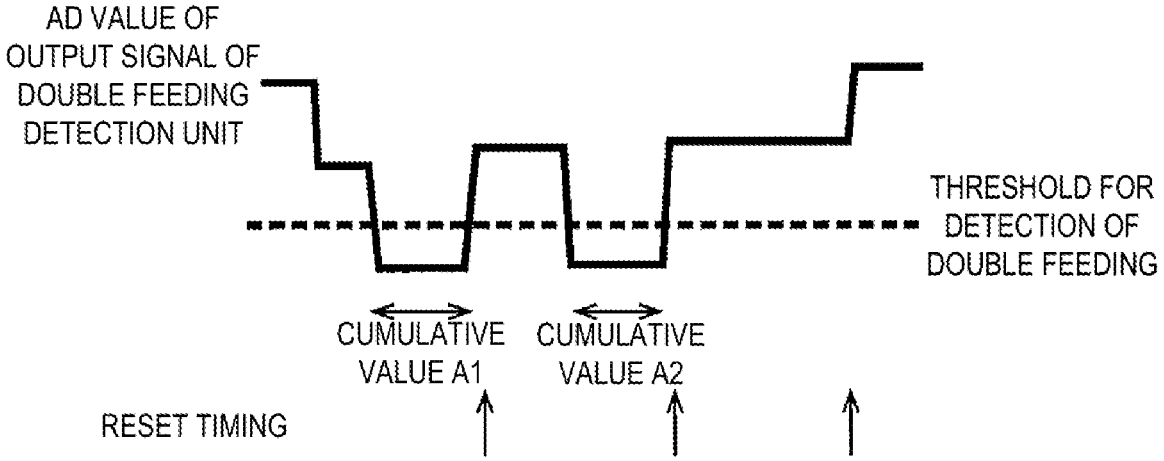
FIG. 16 is a diagram illustrating an output signal of the double feeding detection unit.

FIG. 16 is a diagram illustrating the course of processing a sheet to which sticky notes are attached at two locations by using the double feeding determination of the present disclosure and a diagram illustrating an output signal of the double feeding detection unit.

In double feeding determination of the present example, the cumulative value increases during the double feeding detection period, and the cumulative value increases to the cumulative value A at the portion with the sticky note A attached. However, the cumulative value is reset in step S115 when the non-detection period is determined to have exceeded the threshold in step S110 after the portion with the sticky note A attached passed the double feeding detection unit 14.

Thus, when the portion with the sticky note B attached starts to pass the double feeding detection unit 14, the cumulative value newly starts increasing from the reset state. Then, when the portion with the sticky note B attached passes the double feeding detection unit 14, the cumulative value increases to the cumulative value B. Because both the cumulative value A and the cumulative value B are less than the detection length, it is not determined that the cumulative value exceeds the theoretical threshold in step S120. Furthermore, when the non-detection period is then determined to have exceeded the threshold in step S110, the cumulative value is reset. Further, the cumulative value is reset for the rear end of the sheet.

Figure 17:
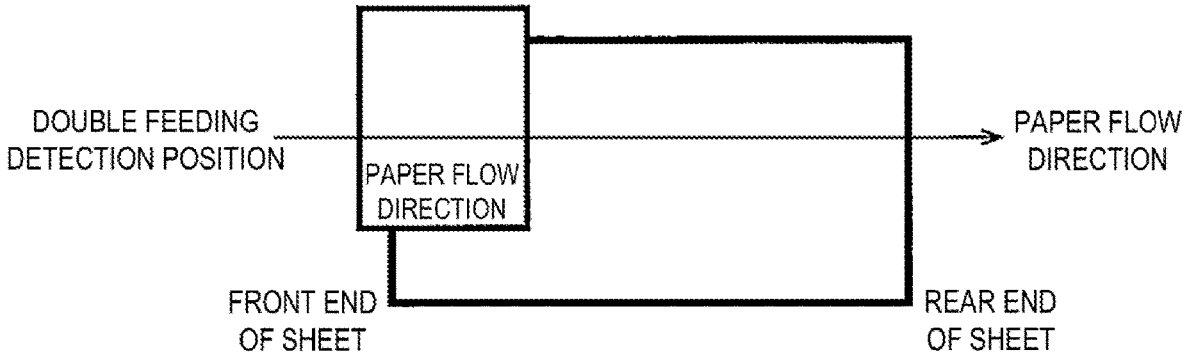
FIG. 17 is a top view of a sheet.
Figure 18:
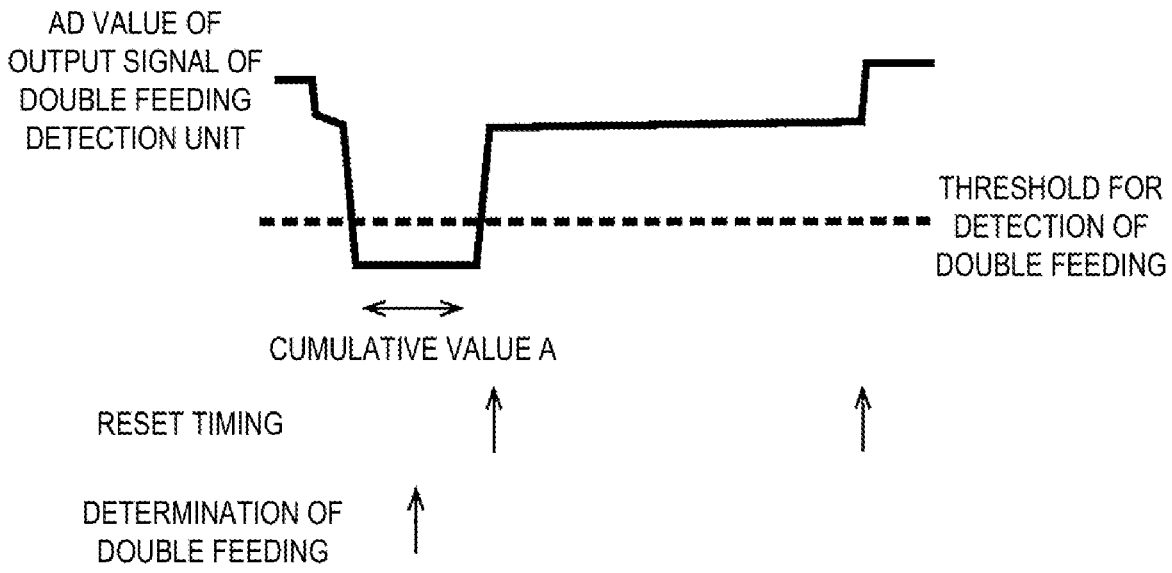
FIG. 18 is a diagram illustrating an output signal of the double feeding detection unit.

FIGS. 17 and 18 are diagrams illustrating the course of transporting a specific document (minimum sheet) overlapping plain paper by using the double feeding determination of the related art, and FIG. 17 is a top view of the sheet, and FIG. 18 is a diagram illustrating an output signal of the double feeding detection unit.

When a specific document (minimum sheet) overlaps plain paper, the portion on which the minimum sheet overlaps is thick as illustrated in FIG. 17. For this reason, when the minimum sheet starts passing the double feeding detection unit 14, the output signal of the double feeding detection unit 14 becomes low and less than the threshold of double feeding detection.

When the double feeding determination of the related art is applied, the cumulative value increases during the double feeding detection period, and when the cumulative value exceeds a certain value equivalent to 10 mm that is the threshold, a notification of a double feeding error is given.

Figure 19:
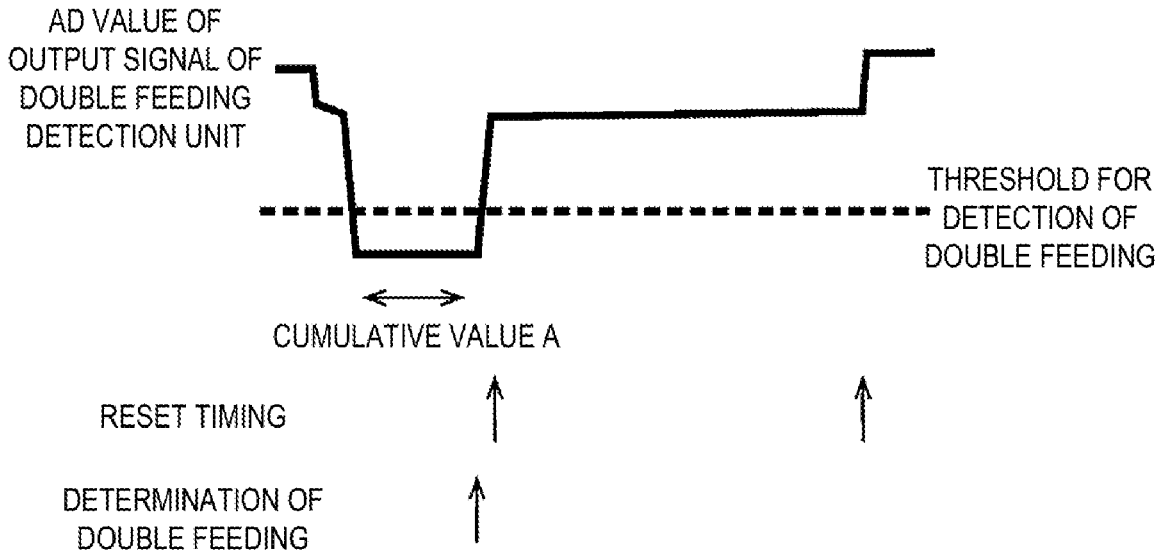
FIG. 19 is a diagram illustrating an output signal of the double feeding detection unit.

Next, FIG. 19 is a diagram illustrating the course of transporting a specific document (minimum sheet) overlapping plain paper by using the double feeding determination of the present disclosure and is a diagram illustrating an output signal of the double feeding detection unit.

In the double feeding determination of the present example, the cumulative value increases during the double feeding detection period, and the cumulative value increases to the cumulative value A at the portion from the front end of the sheet to the attached portion with the overlapping minimum sheet. Because the detection length is roughly set to the length of the minimum sheet, the control unit 15 determines that the cumulative value is equal to or greater than the theoretical threshold in step S120 when the minimum sheet passes the double feeding detection unit 14, determines occurrence of double feeding in step S125, and performs processing such as notification of the double feeding error. When the minimum sheet passed the double feeding detection unit and the non-detection period is determined to have exceeded the threshold in step S110, the cumulative value is reset. Furthermore, the cumulative value is reset for the rear end of the sheet.

Figure 20:
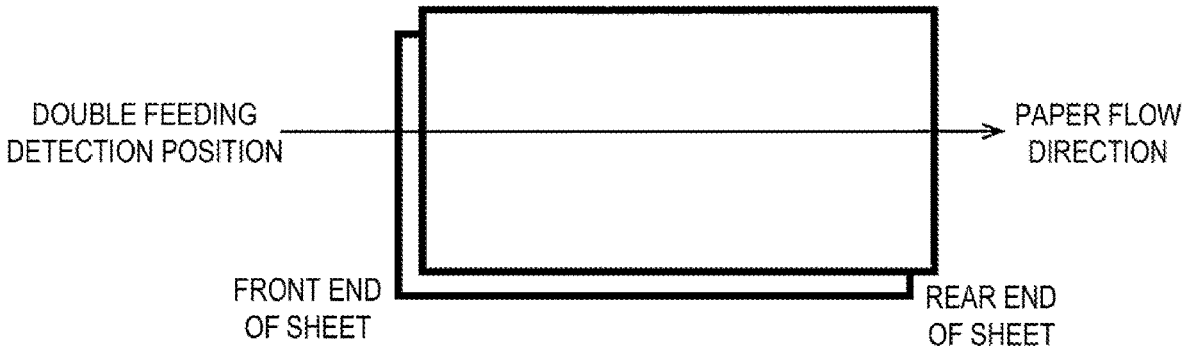
FIG. 20 is a top view of a sheet.
Figure 21:
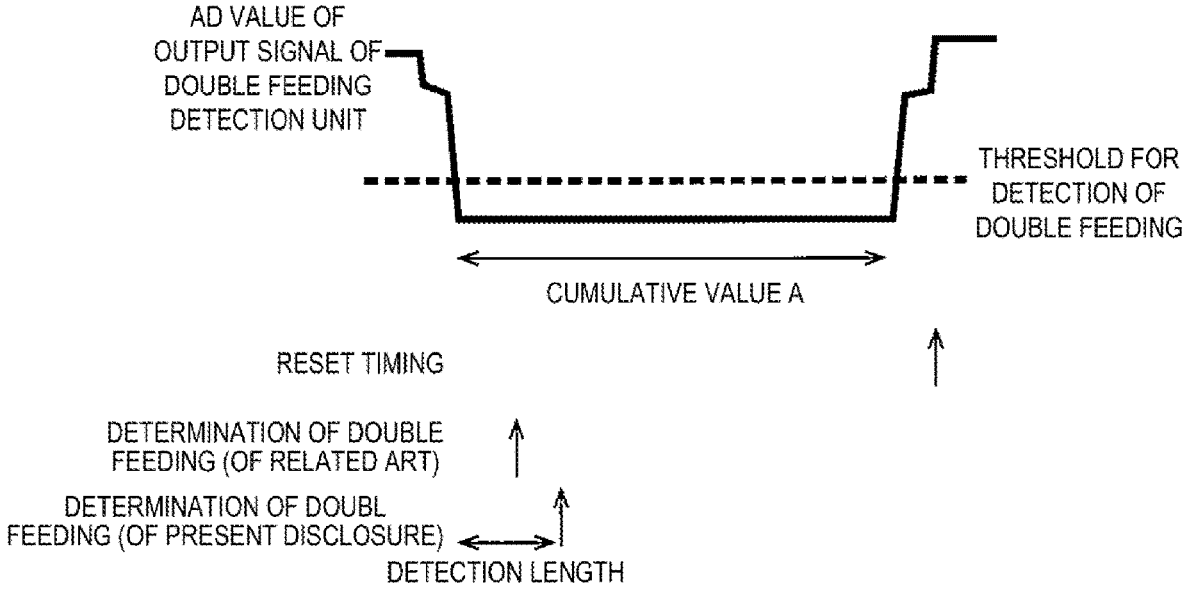
FIG. 21 is a diagram illustrating an output signal of the double feeding detection unit.

FIGS. 20 and 21 are diagrams illustrating the course of transporting overlapping plain paper, and FIG. 20 is a top view of the sheet, and FIG. 21 is a diagram illustrating an output signal of the double feeding detection unit.

Double feeding has occurred at the location close to the front end of the sheet, and the cumulative value A has increased. When the double feeding determination of the related art is applied, the cumulative value increases during the double feeding detection period, and when the cumulative value exceeds a certain value equivalent to 10 mm that is the threshold, a notification of a double feeding error is given. When the double feeding determination of the present disclosure is applied, the control unit 15 determines that the cumulative value is equal to or greater than the theoretical threshold in step S120 if the cumulative value A exceeds the detection length, determines occurrence of double feeding in step S125, and performs processing such as notification of a double feeding error. Further, the cumulative value A is reset for the rear end of the sheet.

Figure 22A:
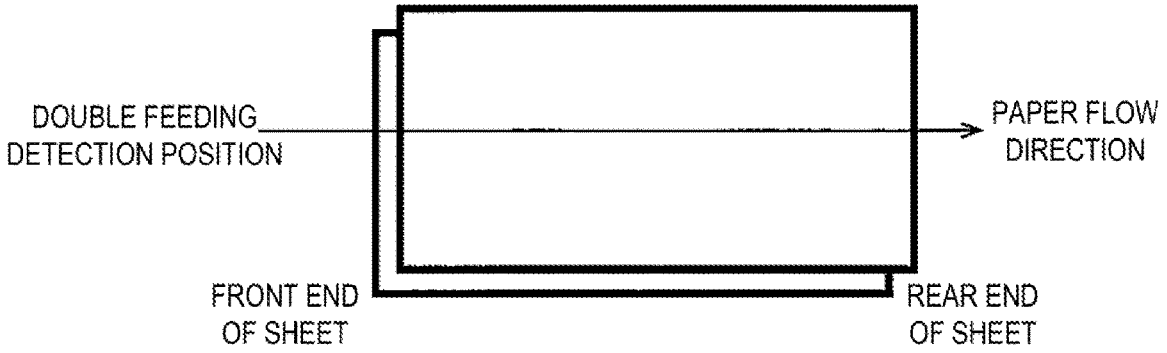
FIG. 22A is a top view of a sheet.
Figure 22B:
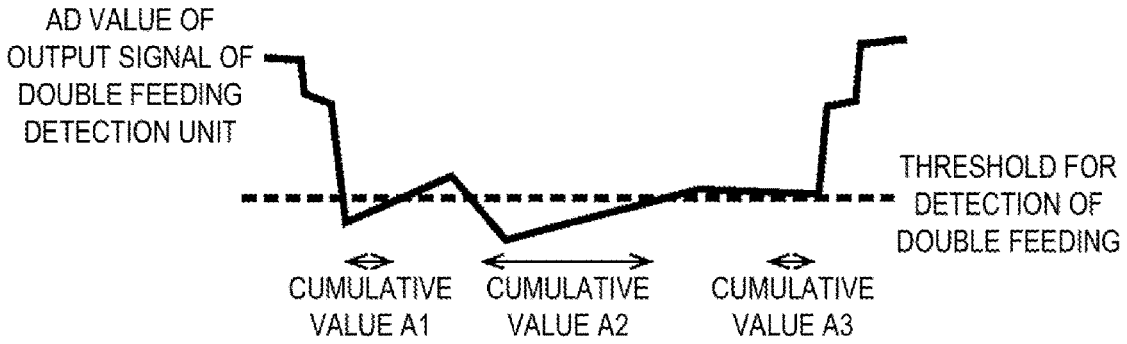
FIG. 22B is a diagram illustrating an output signal of the double feeding detection unit.
Figure 22C:
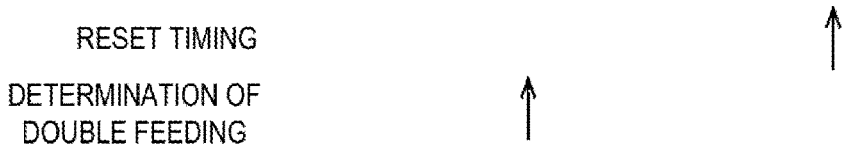
FIG. 22C is a diagram illustrating determination of double feeding using a determination method of the related art.
Figure 22D:
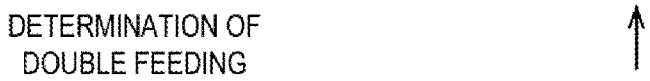
FIG. 22D is a diagram illustrating determination of double feeding according to the present disclosure.

FIG. 22 is a diagram illustrating the course of double feeding of thin paper, FIG. 22A is a top view of the sheet, FIG. 22B is a diagram illustrating an output signal of the double feeding detection unit, FIG. 22C is a diagram illustrating double feeding determination according to the determination method of the related art, and FIG. 22D is a diagram illustrating double feeding determination of the present disclosure.

The control unit 15 does not perform the processes of step S110 and step S115 when it is determined that the sheets are not thin paper in step S105. That is, no processing of resetting the cumulative value is performed when the non-detection period exceeds the threshold. Processing performed when the sheets are determined not to be thin paper is referred to as a first mode, and processing performed when the sheets are thin paper is referred to as a second mode.

When double feeding of thin paper occurs as illustrated in FIG. 22A, the output signal of the double feeding detection unit 14 is not below the threshold for the double feeding detection at all times, and is in an unstable state as illustrated in FIG. 22B.

For example, when the double feeding determination of the related art is applied, the cumulative value increases in the period in which the output signal of the double feeding detection unit 14 is less than the threshold for the double feeding detection, and the cumulative value increases to a cumulative value A1, a cumulative value A2, and a cumulative value A3 in the period in which the output signal is less than the threshold. However, double feeding is determined when the cumulative value exceeds a value equivalent to 10 mm that is the threshold.

On the other hand, when the sheet is determined as thin paper in the present example, the second mode is implemented and since the cumulative value is not reset even when the non-detection period exceeds the threshold, the cumulative value becomes the cumulative value A1, the cumulative value A2, and the cumulative value A3 in the same manner. Then, double feeding is determined when the cumulative value exceeds the detection length.

In this way, in the case of thin paper, there are cases in which double feeding is hard to determine based on the cumulative value and the theoretical threshold, including reset of the cumulative value. For this reason, in the case of thin paper, double feeding is determined by using a separately prepared threshold, without resetting the cumulative value, and double feeding can be determined even if the sheet is thin paper.

Figure 23A:
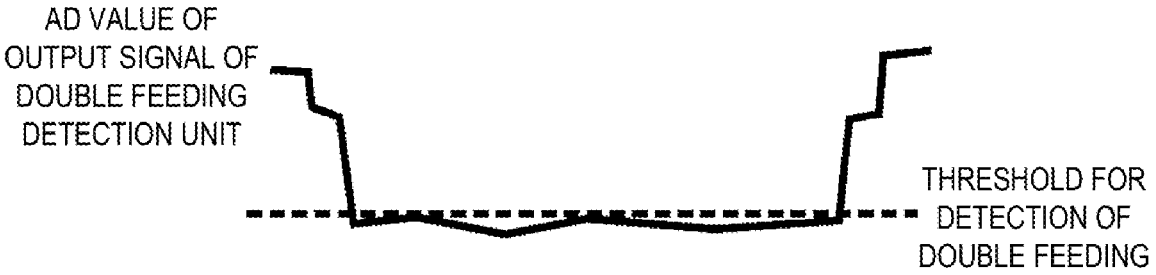
FIG. 23A is a diagram illustrating an output signal of the double feeding detection unit.
Figure 23B:
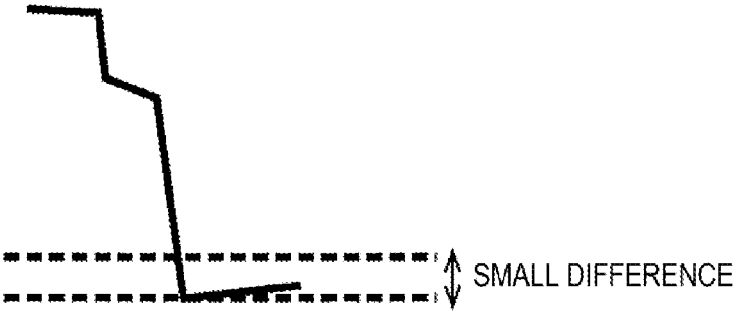
FIG. 23B is an enlarged view of thin paper.
Figure 23C:
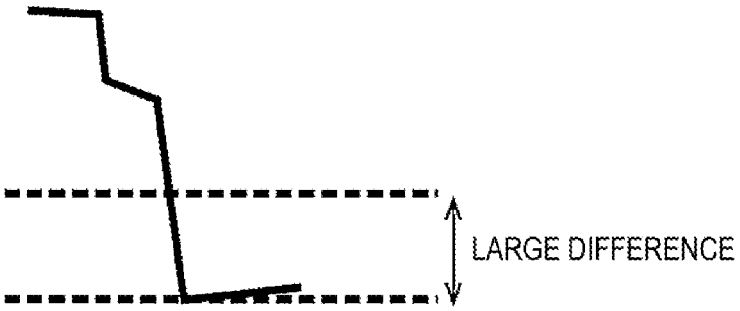
FIG. 23C is an enlarged view of plain paper.

FIG. 23 includes diagrams illustrating an example of determining whether a sheet is thin paper, FIG. 23A is a diagram illustrating an output signal of the double feeding detection unit, FIG. 23B is an enlarged view of the case of thin paper, and FIG. 23C is an enlarged view of the case of plain paper.

When double feeding of thin paper occurs even though calibration has been performed successfully, the output signal of the double feeding detection unit 14 has a small difference from the threshold for double feeding detection as illustrated in FIG. 23B. In contrast, when double feeding of plain paper occurs, the difference between the output signal of the double feeding detection unit 14 and the threshold of the double feeding detection is large as illustrated in FIG. 23C.

Thus, it may be possible to determine that the thin paper has been double-fed based on the result of comparing the difference to a predetermined threshold.

Further, the determination of whether the sheet is thin paper in step S105 may be made by performing preliminary determination of double feeding as described above for a predetermined period after the output signal of the double feeding detection unit 14 becomes less than the threshold. In the preliminary determination of double feeding, the number of times that the output signal of the double feeding detection unit 14 becomes less than the threshold is increased to the counter variable. Further, the cumulative value is not reset in this preliminary determination.

The predetermined period is set to the period from when the output signal of the double feeding detection unit 14 becomes less than the threshold to when sampling is performed a predetermined number of times. The predetermined number of times is set to the number of times that double feeding of the thin paper can be stably detected even when the output signal of the double feeding detection unit 14 is affected by disturbances such as noise or wrinkles of the thin paper. The predetermined period may be set to, for example, the period from when the output signal of the double feeding detection unit 14 becomes less than the threshold to when sampling is performed five times.

When double-fed thin paper is detected, the output signal of the double feeding detection unit 14 becomes unstable as illustrated in FIG. 22B. In other words, when double-fed thin paper is detected, the output signal indicates an irregular pattern in which the output signal is greater or less than the threshold. Therefore, the sheet is determined as thin paper when the output signal indicates an irregular pattern in the predetermined period. Specifically, after the output signal is less than the threshold once, the number of times that the output signal becomes greater than the threshold and then less than the threshold again is counted, and if the count value is equal to or less than a predetermined value, the sheet is determined as thin paper. For example, if the predetermined value is set to three times, and the output signal is greater than the threshold and then becomes two times that is less than the threshold value within the predetermined period, the sheet may be determined as thin paper.

The processing of double feeding determination is as described above. Next, the processing of changing a setting according to a user's environment will be described.

The control unit 15 determines whether there is a threshold input by a user operation in step S140. The control unit 15 causes the touch panel 16 to display a menu in advance to allow the user to input various set values. The control unit 15 can acquire the user's operation content resulting from a touch operation by the user to determine whether there is a threshold input by the user operation. The control unit 15 sets the input threshold to a predetermined variable in step S145.

Examples of a settable threshold include a theoretical threshold, an overlapping margin, a terminal variation, and the like.

Because a threshold can be set according to the user's environment in this way, usability for the user can be ensured.

According to the present example, whether double feeding has occurred can be determined not only based on a detection result of the detection unit along the transport path but also based on the relationship between characteristics of the transport path and the transport length during detection of double feeding, and thus it is possible to reduce erroneously determining double feeding and stopping processing, to set free the user from being troubled, and therefore to provide a document transport device and the like with improved convenience.

Further, it is needless to say that the present disclosure is not limited to the examples described above. It should be understood by those skilled in the art that the followings are disclosed as examples of the present disclosure, which are:

appropriately changing and applying a combination of mutually exchangeable members and configurations disclosed in the examples;

although not disclosed in the examples, appropriately replacing members and configurations that are interchangeable with the members and configurations that are known techniques and disclosed in the examples, and changing and applying a combination thereof; and although not disclosed in the examples, appropriately replacing members and configurations that can be appropriately replaced by a person skilled in the art as substitutes for the members and configurations disclosed in the examples based on known techniques and the like, and changing and applying a combination thereof.

Further, when a sheet is determined as a predetermined medium, in addition to thin paper, the second mode in which the cumulative value is not reset even when the detection period exceeds the threshold and double feeding is determined when the cumulative value exceeds the detection length may be implemented.

What is claimed is:

1. A document transport device comprising:

a placement unit on which a document is placed;

a transport unit configured to transport the document placed on the placement unit along a predetermined transport path;

a processing unit configured to perform processing on the transported document;

a double feeding detection unit configured to detect double feeding of the document along the transport path; and a control unit configured to determine occurrence of double feeding, wherein the control unit acquires a theoretical threshold corresponding to the transport path and a calculation value calculated based on a detection result of the double feeding detection unit and a transport length of the document, determines the occurrence of double feeding when the calculation value is more than the theoretical threshold, determines non-occurrence of double feeding when the calculation value is less than the theoretical threshold, and resets the calculation value when a status that the double feeding is detected by the double feeding detection unit changes to a status that the double feeding is not detected.

2. The document transport device according to claim 1, wherein the double feeding detection unit detects double feeding of the document at a fixed interval, the calculation value is a cumulative value obtained by counting the number of times double feeding is detected at a fixed interval in a period in which double feeding is detected, and the control unit resets the cumulative value when double feeding is no longer detected and the cumulative value does not meet the theoretical threshold.

3. The document transport device according to claim 2, wherein the control unit has a first mode in which a thick document is transported and a second mode in which a thin document is transported, and in the second mode, the control unit does not reset the cumulative value even if the cumulative value does not meet the theoretical threshold when the double feeding is no longer detected.

4. The document transport device according to claim 1, wherein the theoretical threshold is a value obtained by subtracting a variation in an end portion of a specific document in a transport direction from a length of the specific document in the transport direction.

5. The document transport device according to claim 1, wherein the transport unit includes a first pair of transport rollers that transport the document to the processing unit and a second pair of transport rollers that transport the document processed by the processing unit, and a length of a specific document in a direction in which the document is transported is longer than a length from a nip position of the first pair of transport rollers to a nip position of the second pair of transport rollers.

6. The document transport device according to claim 5, wherein the specific document is a business card.

7. The document transport device according to claim 1, wherein the specific document is an instant photographic sheet.

8. The document transport device according to claim 1, comprising:

an operation unit configured to receive an operation of a user, wherein the control unit is configured to change the theoretical threshold based on information input from the operation unit.

9. The document transport device according to claim 1, wherein the processing unit is a reading unit configured to read the transported document.

10. A document transport method of a document transport device including a placement unit on which a document is placed, a transport unit configured to transport the document placed on the placement unit along a predetermined transport path, a processing unit configured to perform processing on the transported document, and a double feeding detection unit configured to detect double feeding of the document along the transport path, the document transport method comprising:

acquiring a theoretical threshold corresponding to the transport path and a calculation value calculated based on the detection result of the double feeding detection unit and a transport length of the document;

resetting the calculation value when a status that the double feeding is detected by the double feeding detection unit change to a status that the double feeding is not detected; and determining occurrence of double feeding when the calculation value is more than the theoretical threshold, and determining non-occurrence of double feeding when the calculation value is less than the theoretical threshold.

11. A document transport device comprising:

a placement unit on which a document is placed;

a transport unit configured to transport the document placed on the placement unit along a predetermined transport path;

a processing unit configured to perform processing on the transported document;

a double feeding detection unit configured to detect double feeding of the document along the transport path; and a control unit configured to determine occurrence of double feeding, wherein the control unit acquires a theoretical threshold corresponding to the transport path and a calculation value calculated based on a detection result of the double feeding detection unit and a transport length of the document, determines the occurrence of double feeding when the calculation value is greater than the theoretical threshold, and determines non-occurrence of double feeding when the calculation value is smaller than the theoretical threshold, and the theoretical threshold is a value obtained by subtracting a variation in an end portion of a specific document in a transport direction from a length of the specific document in the transport direction.

12. The document transport device according to claim 11, wherein the double feeding detection unit detects double feeding of the document at a fixed interval, the calculation value is a cumulative value obtained by counting the number of times double feeding is detected at a fixed interval in a period in which double feeding is detected, and the control unit resets the cumulative value when double feeding is no longer detected, and the cumulative value does not meet the theoretical threshold.

13. The document transport device according to claim 12, wherein the control unit has a first mode in which a thick document is transported and a second mode in which a thin document is transported, and in the second mode, the control unit does not reset the cumulative value even if the cumulative value does not meet the theoretical threshold when the double feeding is no longer detected.

14. The document transport device according to claim 11, wherein the transport unit includes a first pair of transport rollers that transport the document to the processing unit and a second pair of transport rollers that transport the document processed by the processing unit, and a length of a specific document in a direction in which the document is transported is longer than a length from a nip position of the first pair of transport rollers to a nip position of the second pair of transport rollers.

15. The document transport device according to claim 14, wherein the specific document is a business card.

16. The document transport device according to claim 11, wherein the specific document is an instant photographic sheet.

17. The document transport device according to claim 11, comprising:

an operation unit configured to receive an operation of a user, wherein the control unit is configured to change the theoretical threshold based on information input from the operation unit.

18. The document transport device according to claim 11, wherein the processing unit is a reading unit configured to read the transported document.

* * * * *